US010835783B2

(12) United States Patent
Pandit

(10) Patent No.: US 10,835,783 B2
(45) Date of Patent: Nov. 17, 2020

(54) DEVICE FOR IMPROVING FORM AND FUNCTION OF SPORTS PEOPLE

(71) Applicant: Akshay Pandit, New Delhi (IN)

(72) Inventor: Akshay Pandit, New Delhi (IN)

( * ) Notice: Subject to any disclaimer, the term of this patent is extended or adjusted under 35 U.S.C. 154(b) by 259 days.

(21) Appl. No.: 15/563,522

(22) Filed: Sep. 29, 2017

(65) Prior Publication Data

US 2018/0085631 A1 Mar. 29, 2018

Related U.S. Application Data

(63) Continuation-in-part of application No. PCT/IB2016/051875, filed on Apr. 1, 2016.

(30) Foreign Application Priority Data

Apr. 1, 2015 (IN) ..... 937/DEL/2015

(51) Int. Cl.

| | |
|---|---|
| ***A63B 26/00*** | (2006.01) |
| ***A63B 69/00*** | (2006.01) |
| *A63B 69/38* | (2006.01) |
| *A63B 69/36* | (2006.01) |
| *A63B 22/00* | (2006.01) |
| *A63B 71/06* | (2006.01) |
| *A63B 21/072* | (2006.01) |

(52) U.S. Cl.

CPC ..... *A63B 26/003* (2013.01); *A63B 69/00* (2013.01); *A63B 21/072* (2013.01); *A63B 69/3667* (2013.01); *A63B 69/38* (2013.01); *A63B 2022/0092* (2013.01); *A63B 2071/0694* (2013.01)

(58) Field of Classification Search

CPC ..... A63B 24/0003; A63B 24/0006

See application file for complete search history.

(56) References Cited

U.S. PATENT DOCUMENTS

| | | | |
|---|---|---|---|
| 4,828,256 | A | 5/1989 | Lee |
| 4,998,720 | A | 3/1991 | Kim |
| 5,004,231 | A | 4/1991 | Alread |
| 5,738,613 | A | 4/1998 | Clayton |
| D399,280 | S | 10/1998 | Griffin |

(Continued)

OTHER PUBLICATIONS

International Search Report from International Application No. PCT/IB2016/051875, dated Aug. 23, 2016.

*Primary Examiner* — James S. McClellan

(74) *Attorney, Agent, or Firm* — Zilka-Kotab, P.C.

(57) ABSTRACT

In an aspect, the present disclosure relates to a foot orientation device having a semi-oval shaped frame, wherein the frame is configured to accommodate both feet of a user in one or more orientations selected from open foot body orientation, closed foot body orientation, center foot body orientation, center open foot body orientation, and center closed foot body orientation, wherein any of these orientations enable the user to practice and achieve alignment of at least one body part and learn loading of the feet in each orientation to understand positioning and relationship of hip and back, and wherein when the dominant foot is in open orientation, the user uses straight line pathway for an intersectional impact creation, and wherein when the dominant foot is in closed orientation, the user uses circular line pathway for the intersectional impact creation.

19 Claims, 10 Drawing Sheets

(56) References Cited

U.S. PATENT DOCUMENTS

| | | | | |
|---|---|---|---|---|
| 6,652,421 | B1 | 11/2003 | Chen | |
| 8,033,966 | B2 | 10/2011 | Ayoub | |
| 8,613,716 | B2 | 12/2013 | Summit et al. | |
| 8,663,141 | B2 | 3/2014 | Garth et al. | |
| 9,623,285 | B1 * | 4/2017 | Ruiz | A63B 24/0062 |
| 2003/0211916 | A1 * | 11/2003 | Capuano | A63B 21/0628 482/8 |
| 2007/0099731 | A1 | 5/2007 | Weber et al. | |
| 2016/0103970 | A1 * | 4/2016 | Liu | G06Q 50/01 705/2 |

* cited by examiner

DEVICE FOR IMPROVING FORM AND FUNCTION OF SPORTS PEOPLE

FIELD OF THE DISCLOSURE

The present disclosure relates to systems and methods for physical development of human beings, and more particularly to training devices for sportsmen.

BACKGROUND

Background description includes information that may be useful in understanding the present invention. It is not an admission that any of the information provided herein is prior art or relevant to the presently claimed invention, or that any publication specifically or implicitly referenced is prior art.

Systems, methods and devices for physical development of human beings and training them for developing their skills in specific sports are very well known. These work on principles and knowledge of body structures and its movements in defined patterns and fashions in order to train for specific muscle strength and body movements.

Some such devices include punching bags, exercise boards, weight lifting machines, bench bars, dumbbells etc. etc. All these however, do not emphasis upon foot posture that could be of importance in many exercises and sports, more particularly in sports such as lawn tennis, badminton, boxing etc. Also, present devices do not provide for guiding various body actions in well defined directions and defined pathways, neither do they allow for standardization of data collection for different body structures for uniform comparisons for evaluations and training purposes.

Also, due to irregular living habits including the variable of the use of either of the hands (left/right), consequent to incorrect ways of playing games or stretching/exercising or simply due to unresolved injuries, changes and errors occur in the alignment/proportionality of the human body. Such changes and errors can affect personal efficiency at various levels.

Hence there is a requirement in the art for a correct and easily teachable way to people the correct way of exercising so that they are able to carry out their own minor re-alignments along with being able to stretch/stress their body correctly in a properly calibrated fashion.

Hence, there is therefore a need in the art an improved technique and set of tools for training, exercising, and body conditioning.

All publications herein are incorporated by reference to the same extent as if each individual publication or patent application were specifically and individually indicated to be incorporated by reference. Where a definition or use of a term in an incorporated reference is inconsistent or contrary to the definition of that term provided herein, the definition of that term provided herein applies and the definition of that term in the reference does not apply.

In some embodiments, the numbers expressing quantities of ingredients, properties such as concentration, reaction conditions, and so forth, used to describe and claim certain embodiments of the invention are to be understood as being modified in some instances by the term "about". Accordingly, in some embodiments, the numerical parameters set forth in the written description and attached claims are approximations that can vary depending upon the desired properties sought to be obtained by a particular embodiment. In some embodiments, the numerical parameters should be construed in light of the number of reported significant digits and by applying ordinary rounding techniques. Notwithstanding that the numerical ranges and parameters setting forth the broad scope of some embodiments of the invention are approximations, the numerical values set forth in the specific examples are reported as precisely as practicable. The numerical values presented in some embodiments of the invention may contain certain errors necessarily resulting from the standard deviation found in their respective testing measurements.

As used in the description herein and throughout the claims that follow, the meaning of "a," "an," and "the" includes plural reference unless the context clearly dictates otherwise. Also, as used in the description herein, the meaning of "in" includes "in" and "on" unless the context clearly dictates otherwise.

The recitation of ranges of values herein is merely intended to serve as a shorthand method of referring individually to each separate value falling within the range. Unless otherwise indicated herein, each individual value is incorporated into the specification as if it were individually recited herein. All methods described herein can be performed in any suitable order unless otherwise indicated herein or otherwise clearly contradicted by context. The use of any and all examples, or exemplary language (e.g. "such as") provided with respect to certain embodiments herein is intended merely to better illuminate the invention and does not pose a limitation on the scope of the invention otherwise claimed. No language in the specification should be construed as indicating any non-claimed element essential to the practice of the invention.

Groupings of alternative elements or embodiments of the invention disclosed herein are not to be construed as limitations. Each group member can be referred to and claimed individually or in any combination with other members of the group or other elements found herein. One or more members of a group can be included in, or deleted from, a group for reasons of convenience and/or patentability. When any such inclusion or deletion occurs, the specification is herein deemed to contain the group as modified thus fulfilling the written description of all Markush groups used in the appended claims.

SUMMARY

The present disclosure relates to systems and methods for physical development of human beings, and more particularly to training devices for sportsmen.

In an aspect, the present disclosure relates to a foot orientation device having a semi-oval shaped frame, wherein the frame is configured to accommodate at least one foot of a user in one or more energy orientations selected from open foot body orientation, closed foot body orientation, center foot body orientation, center open foot body orientation, and center closed foot body orientation, wherein any of these orientations enable the user to practice and achieve alignment of at least one body part and learn loading of the foot/feet in each orientation to match center of gravity for orientations and understand positioning and relationship/loadings of hip, back and at least one phase sensitive action, and wherein when the dominant foot is in open orientation, the user uses straight line pathway for an intersectional impact creation, and wherein when the dominant foot is in closed orientation, the user uses circular line pathway for the intersectional impact creation.

In an aspect, when the dominant foot is in center orientation, the user has an option to choose the circular line pathway or the straight line pathway or a combination thereof to compliment for an in-line intersectional interaction or an intersectional interaction to compliment the at least one phase sensitive action.

In another aspect, the foot orientation device is operatively coupled with a loading machine, and wherein the loading machine enables a user to load his/her body for learning and improving body loadings and body parts interaction for intersectional impact principle, further wherein the loading machine comprises a pole having a channel in which a socket holding a ball is fixed at a position, and wherein the ball is movable in any direction using a lever that is configured with a resistive mechanism to impart resistance to movement of the ball and the lever.

In another aspect, height of the ball on the pole is adjustable to create variety of loadings of body of the user representing various heights impact points. In another aspect, a plurality of holes are configured on the pole to provide variable resistance through use of various heights or angles. In another aspect, the pole is configured with an adapter at its top, wherein the adapter is used for connecting any or a combination of a bladder, a punching bag, and a resistance band.

In another aspect, the lever and the ball can be detachable from the pole and can be used for inline intersectional impact, and wherein the lever is hollow and operatively coupled with a detachable handle such that the handle when detached from the lever, the handle is used as a thumb loading exerciser.

In another aspect, the lever and the ball are detachable from the pole and used for intersectional impact and a stopper is installed with the lever, wherein the lever is hollow and operatively coupled with a detachable handle such that the handle when detached from the lever is usable as a thumb loading exerciser that can be coupled with a ball, and wherein the lever is attached to handle of a sports implement selected from the group consisting of a tennis racquet, a cricket bat and a golf stick.

In another aspect, the thumb loading exerciser can be operatively coupled with a body brace, wherein the body brace is configured to function in a way that enables the user to apply a punching action in a straight line orientation when the dominant side foot is in open position, and apply the punching action in a circular manner for circular orientation of energy when the dominant side foot is in closed position. In yet another aspect, the body brace can be of any or a combination of X, I, - - - , circular, semi-circular, oval, or opposite semi-circular shape. In an aspect, the thumb loading exerciser is a single-orientation loading exerciser or a multi-orientation loading exerciser, and wherein the thumb loading exerciser is coupled with a ball.

In an aspect, the band can be configured on a user such that when then foot of the user is relaxed, the band pulls the foot upwards, and wherein when the foot is upward, a desired orientation is applied. In an aspect, the band can be operatively coupled with a foot through exerciser for a large ball, wherein the foot through exerciser comprises a pipe that is coupled with the large ball such that the pipe is movable from side-to-side without moving the large ball to enable understanding of how the large ball should be approached through foot for impact creation The present disclosure further relates to a method of creating a reference ball, said method comprising the steps of marking a first point and a second point on center of two hemispheres of the ball; piercing a needle through the first point maintaining zero degree deviation from horizontal plane; determining whether the needle passes through the second point to determine degree of deviation of the needle from the second point; based on the degree of deviation, expanding or compressing two halves of the ball until a zero degree of deviation is achieved; creating the reference ball based on the zero degree of deviation; and creating at least one final ball based on the reference ball, wherein for the at least one final ball is function, a quarter space rule compensation is required and presents itself as a variation choice.

In an aspect, the reference ball can be used on a string attached to a body brace. The reference ball is also usable for training and is the fundamental geometry and/or ball size reference for all possible tools. In an aspect, the reference ball can be reduced in size so as to allow the ball to be used as a thumb spacer, wherein the thumb spacer has a hole that allows for the thumb spacer to be installed upon and around thumb of the user.

The present disclosure further relates to a center loading bar comprising load to be fixed in the center of the bar for weight training so as to allow center integrated loading of the body of the user.

The present disclosure further provides a twisting machine comprising a base that allows different energy orientations to be achieved, wherein a portion of the base is cut out to facilitate said energy orientations.

The present disclosure further provides a center loading bar comprising load to be fixed in the center of the bar for unique weight training loadings or for center loading of a user so as to allow center integrated loading of the body of the user.

Aspects of the present disclosure further relate to a data collection device comprising a data collection system configured to detect design parameters and form and functional parameters of an entity based on movement of said entity, a data aggregation system configured to enable aggregation of the design parameters, form and functional parameters and variations and progressions of the entity, and further configured to generate a multi-calibrated data based on said aggregation, wherein the multi-calibrated data comprises information of a plurality of reference points, and a data simulation system configured to simulate the multi-calibrated data of the entity with respect to at least one of the plurality of reference points so as to enable enhancement of the design parameters and form and functional parameters of the entity.

In an aspect, the device is attached to a body brace configured with body part of a user. In an aspect, the body brace is of any or a combination of X, I, - - - , circular, semi-circular, oval, opposite semi-circular or hollow shape.

In an aspect, the enhanced design parameters and form and functional parameters of the entity is used for design and development of sports products, training products and physiotherapy products.

The present disclosure further provides a loading machine that enables a user to load his/her body for learning and improving body loadings and body parts interaction for intersectional impact principle, wherein the loading machine comprises a pivotable pole with fixed and or variable resistance having a channel in which a socket holding a ball is fixed at one or more specific positions, and wherein the ball is movable in any direction using a lever that is configured with a resistive mechanism to impart resistance to movement of the ball and or the lever.

Aspects of the present disclosure further relate to a method for developing an article having a defined geometry, the method comprising steps of analyzing one or more reference points associated with the geometry of the article, and implementing energy and phase based predictive reference function on the one or more reference points to support orientation based conditioning of the article.

In an aspect, loading data derived from the device relating to the one or more energy orientations is used for design and development of footwear.

The present disclosure further provides a parameter based system to create form and functions based upon any or a combination of orientations of energy and energy geometry, wherein the orientations can be complimented with intersectional type interactions to create conditionings or reorganizations to at least one aspect of the form and functions of at least one entity, and wherein the conditionings are achieved to create progressions coherent to the parameters to create or reorganize at least one aspect of the form and functions that is increasingly coherent for phase sensitive responses.

In an aspect, loading data derived from functioning of the parameters are used to design and develop products and for training of the at least one entity.

BRIEF DESCRIPTION OF THE DRAWINGS

The accompanying drawings are included to provide a further understanding of the present disclosure, and are incorporated in and constitute a part of this specification. The drawings illustrate exemplary embodiments of the present disclosure and, together with the description, serve to explain the principles of the present disclosure.

DETAILED DESCRIPTION

Figure 1A:
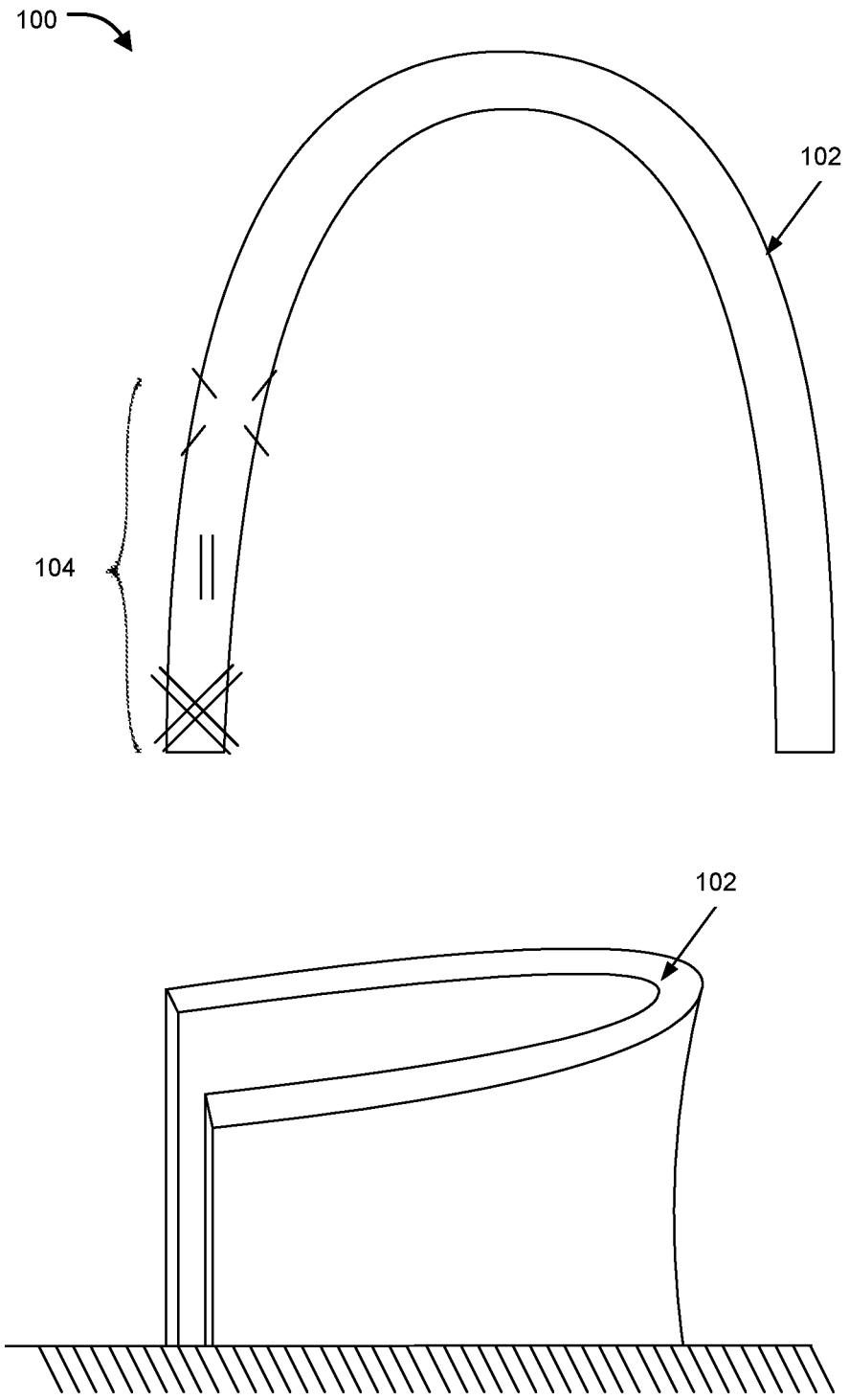
FIG. 1A to 1F illustrate exemplary views of a foot orientation device in accordance with an exemplary embodiment of the present disclosure.

The present disclosure relates to systems and methods for physical development of human beings, and more particularly to training devices for sportsmen.

In an aspect, the present disclosure relates to a foot orientation device having a semi-oval shaped frame, wherein the frame is configured to accommodate at least one foot of a user in one or more energy orientations selected from open foot body orientation, closed foot body orientation, center foot body orientation, center open foot body orientation, and center closed foot body orientation, wherein any of these orientations enable the user to practice and achieve alignment of at least one body part and learn loading of the foot/feet in each orientation to match center of gravity for orientations and understand positioning and relationship/loadings of hip, back and at least one phase sensitive action, and wherein when the dominant foot is in open orientation, the user uses straight line pathway for an intersectional impact creation, and wherein when the dominant foot is in closed orientation, the user uses circular line pathway for the intersectional impact creation.

In an aspect, when the dominant foot is in center orientation, the user has an option to choose the circular line pathway or the straight line pathway or a combination thereof resulting an in-line intersectional impact.

In another aspect, the foot orientation device can be operatively coupled with a loading machine, and wherein the loading machine enables a user to load his/her body for learning and improving body loadings and body parts interaction for intersectional impact principle, further wherein the loading machine comprises a pole having a channel in which a socket holding a ball is fixed at a position, and wherein the ball is movable in any direction using a lever that is configured with a resistive mechanism to impart resistance to movement of the ball and the lever.

In another aspect, height of the ball on the pole is adjustable to create variety of loadings of body of the user representing various heights impact points. In another aspect, a plurality of holes can be configured on the pole to provide variable resistance through use of various heights or angles. In another aspect, the pole can be configured with an adapter at its top, wherein the adapter is used for connecting any or a combination of a bladder, a punching bag, and a resistance band.

In another aspect, the lever and the ball can be detachable from the pole and can be used for inline intersectional impact, and wherein the lever is hollow and operatively coupled with a detachable handle such that the handle when detached from the lever, the handle is used as a thumb loading exerciser.

In another aspect, the foot orientation device can be operatively coupled with an orientation thumb loading exerciser to teach open foot body orientation along with thumb loadings to the user. In an aspect, the orientation thumb loading exerciser can be a single-orientation loading exerciser or a multi-orientation loading exerciser. In another aspect, the thumb loading exerciser can be coupled with a ball.

In another aspect, the thumb loading exerciser can be operatively coupled with a body brace, wherein the body brace is configured to function in a way that enables the user to apply a punching action in a straight line orientation when the dominant side foot is in open position, and apply the punching action in an circular manner for circular orientation of energy when the dominant side foot is in closed position. In yet another aspect, the body brace can be of any or a combination of X, I, - - - , circular, semi-circular, oval, or opposite semi-circular shape.

In an aspect, the band can be configured on a user such that when then foot of the user is relaxed, the band pulls the foot upwards, and wherein when the foot is upward, a desired orientation is applied. In an aspect, the band can be operatively coupled with a foot through exerciser for a large ball, wherein the foot through exerciser comprises a pipe that is coupled with the large ball such that the pipe is movable from side-to-side without moving the large ball to enable understanding of how the large ball should be approached through foot for impact creation The present disclosure further relates to a method of creating a reference ball, said method comprising the steps of marking a first point and a second point on center of two hemispheres of the ball; piercing a needle through the first point maintaining zero degree deviation from horizontal plane; determining whether the needle passes through the second point to determine degree of deviation of the needle from the second point; based on the degree of deviation, expanding or compressing two halves of the ball until a zero degree of deviation is achieved; creating the reference ball based on the zero degree of deviation; and creating at least one final ball based on the reference ball, wherein for the at least one final ball is function, a quarter space rule compensation is required and presents itself as a variation choice.

In an aspect, the reference ball can be used on a string attached to a body brace. The reference ball is also usable for training and is the fundamental geometry and/or ball size reference for all possible tools. In an aspect, the reference ball can be reduced in size so as to allow the ball to be used as a thumb spacer, wherein the thumb spacer has a hole that allows for the thumb spacer to be installed upon and around thumb of the user.

The present disclosure further relates to a center loading bar comprising load to be fixed in the center of the bar for weight training so as to allow center integrated loading of the body of the user.

The proposed disclosure, apart from the tools described herein, enables polarity coherence for energy orientation or geometry for foot body limb combination by enabling a user to apply a punching action in a straight line orientation/pathway when the dominant side foot is in open position, and apply the punching action in an across/circular manner for circular orientation of energy when the dominant side foot is in closed position. This enables functioning of body parts in coherence. The proposed disclosure has also identified that switching of foot orientation to one to another during a defined activity changes energy orientation, causing issues such as lowering of receiving results in sports/health, which discovery has enabled the present invention wherein the switching of foot orientation is avoided during an activity, and such non-intuitive technique/mechanism is used in development of the proposed tools being described hereinafter.

Embodiments herein and the various features and advantageous details thereof are explained with reference to the non-limiting embodiment in the following description. Descriptions of well-known components and processing techniques are omitted so as to not unnecessarily obscure the embodiments herein. The examples used herein are intended merely to facilitate an understanding of ways in which embodiments herein may be practiced and to further enable those of skill in the art to practice the embodiment herein. Accordingly, the description should not be construed as limiting the scope of the embodiment herein.

The description hereinafter of the specific embodiments will so fully reveal the general nature of the embodiments herein that others can, by applying current knowledge, readily modify or adapt or perform both for various applications such specific embodiments without departing from the generic concept, and, therefore, such adaptations and modifications should and are intended to be comprehended within the meaning and range of equivalents of the disclosed embodiments. It is to be understood that the phraseology or terminology employed herein is for the purpose of description and not of limitation.

Various terms as used herein are defined below. To the extent a term used in a claim is not defined below, it should be given the broadest definition persons in the pertinent art have given that term as reflected in printed publications and issued patents at the time of filing.

FIGS. 1A to 1F illustrate exemplary views of the foot orientation device (hereinafter called the device) in accordance with an exemplary embodiment of the present disclosure.

In an aspect, device 100 disclosed can include a semi-oval shaped frame 102 that is constructed so that it can be affixed about 8" to 18" above the ground level. In another aspect the frame 102 can be about 2" to 3" wide, in such a fashion that it can accommodate partially both feet of a person in orientations as are being elaborated further on herein.

In an aspect device 100 can be at horizontal level. In another aspect, its front can be at a slightly elevated angle.

In an aspect device 100 disclosed can also be configured to be a part of other items say, for example, a school bench and all such embodiments are part of this present disclosure.

In other embodiments, device 100 disclosed can have any shape or form suitable, such as a V shape, as long as it enables feet to be kept on it so as to provide them orientation as described hereunder. The device can be affixed on the floor by any means suitable such as bolts, legs and can also have means to enable it to rest properly balanced on the floor if it is not affixed to it. In another aspect, device disclosed can be conjoined with an appropriate component behind it that can be, for example, another semi-oval device similar or a bar that can hold the various other components described further on.

It is to be understood that device 100 is an exemplary embodiment that enables the foot orientations as being described hereunder to be achieved by means of suitable markings and any device that enables such orientations to be achieved by any means is covered under this disclosure. For example, such markings can be on a straight rod, grooves or pathways, a mat, a circle a square, a rectangle or any other shape. Besides, they can enable only one foot to be put in any of the orientations described, or both feet to be put together in any of the orientations described (as in the exemplary embodiment), or one foot to be put in one orientation followed by the next foot in same or another orientation (as in walking on a bench with such markings) and all such variations are covered under this disclosure.

In another aspect, the frame 102 can be made of strength sufficient to hold a human body weight of say, upto 150 Kgs and of any suitable material such as but not limited to plastic, ceramic, iron etc.

In another aspect the frame 102 can have any means on it to enable both feet of a person (interchangeably referred to as an operator or a sportsperson hereunder) to be put on it in orientations elaborated hereunder. Such means can be, for example, appropriate markings on the frame 102, as illustrated in FIG. 1A as 104.

The various foot orientations are now elaborated hereunder.

The foot orientations as described hereunder can be enabled by the device 100 disclosed and help the people practicing them in proper alignment of various body parts leading to their increased efficiency of body use for different loadings and/or force applications and/or their principles. Also they can lead to resolution or improvement of various musculoskeletal skewing/deviations and inwards orientation of the spine and/or other orientations and/or combinations.

Some foot orientations described herein enable more loading of body weight or weights attached therewith to the skeletal structure while others enable more loading on the soft muscular parts, helping in realigning the same.

The foot orientations so learnt can also help sportsmen in understanding how to use force applied by them more efficiently such as in while playing various games such as but not limited to for tennis shots, punching actions, cricket, badminton etc. They help the body retain matched centre of gravity in (circular vs line orientation/s, which could be examined via the fitness techniques for two fundamental orientations for static use and understanding of the principle/s) various postures and force application so that various orientations can be applied with increased efficiency.

In various embodiments the device can be used along with resistance bands, body braces with resistance bands, for various movements such as forward punching, upper cut actions with proper loading of various body parts and their correct and efficient functional interactions.

Figure 1B:
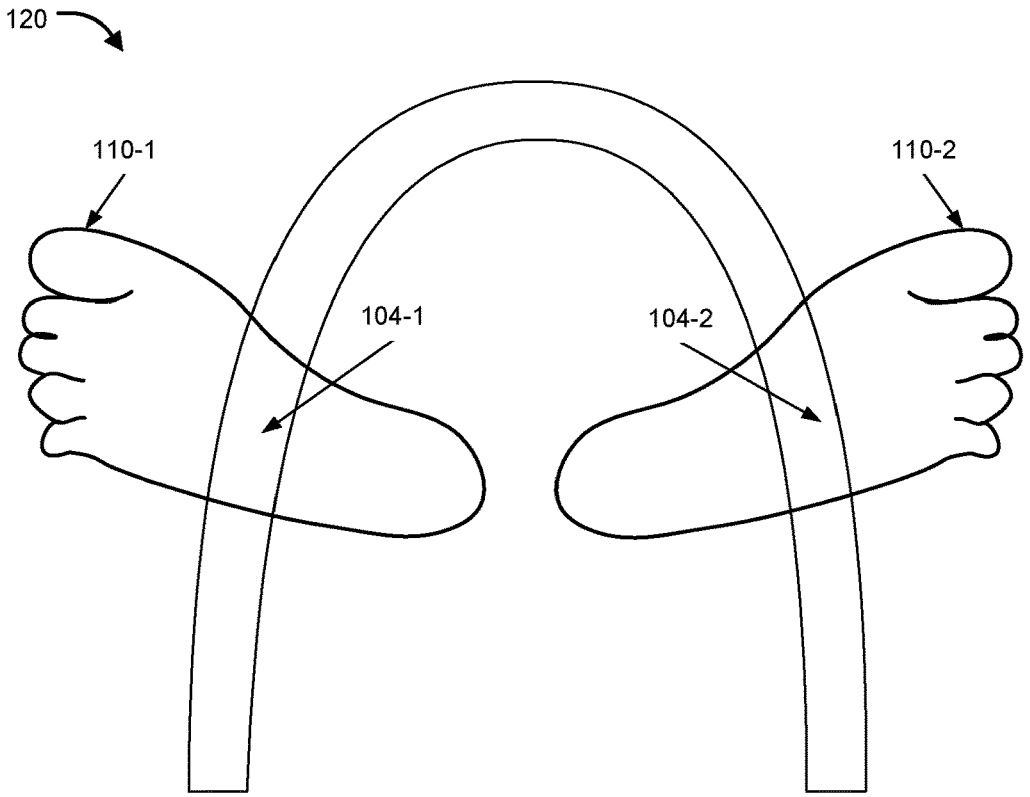

FIG. 1B illustrates the open foot body orientation disclosed.

In this orientation, device disclosed enables arch (104-1 and 104-2) of each foot to be put on the frame 102, with big toes (110-1 and 110-2) of each foot so turned away from each other so as to form an angle of approx. 45 deg (or more) with the horizontal axis for the right foot (also termed as one foot) and 135 degree (or more) with the horizontal axis for the left foot (also termed as the other foot), body weight being balanced/loaded on each foot accordingly.

Figure 1C:
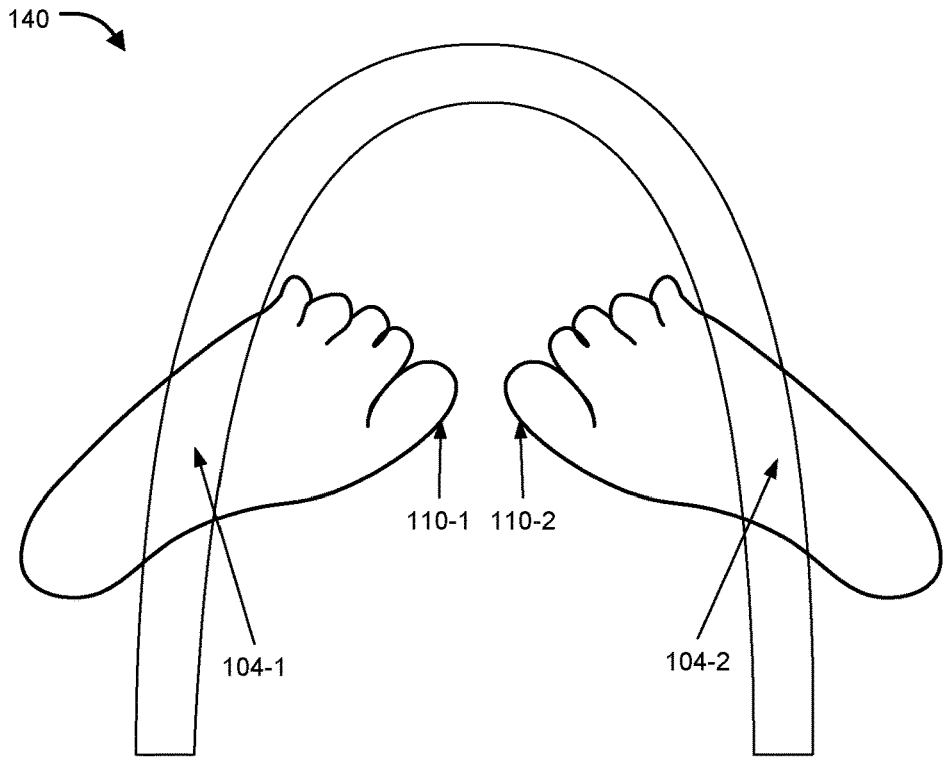

FIG. 1C illustrates the closed foot body orientation disclosed

In this orientation, device disclosed enables arch (104-1 and 104-2) of each foot to be put on the frame, with big toes (110-1 and 110-2) of each feet so turned towards each other so as to form an angle of approx. 135 deg with the horizontal axis for the right foot and 45 degree with the horizontal axis for the left foot, body weight being balanced on each foot accordingly.

Figure 1D:
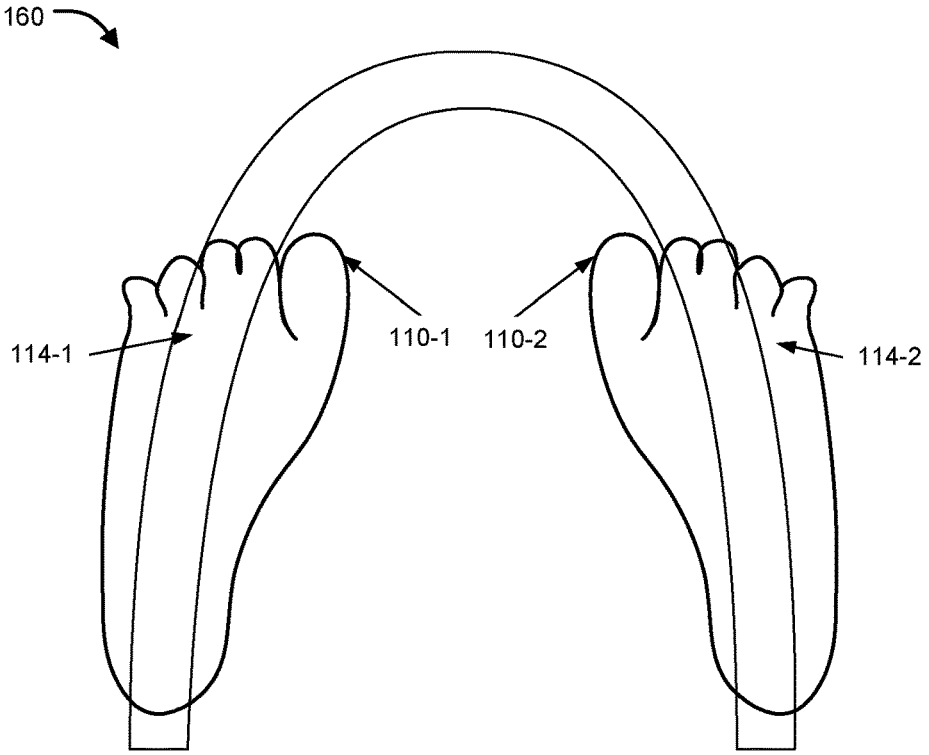

FIG. 1D illustrates the centre foot body orientation disclosed

In this orientation, device disclosed enables both feet to be placed on frame 102 in such a fashion that they are parallel to each other, both being at an angle of approximately 90 degrees to the horizontal, body weight being balanced on each foot accordingly. As illustrated in this position big toes (110-1 and 110-2) are at an angle of approximately 90 degrees to the horizontal, balls (114-1 and 114-2) of the outer toes of each foot rest on the frame 102 and the centre of heel of each foot also rests on the frame 102, as illustrated. In essence, in this orientation, the foot is centrally balanced on the frame 102.

Figure 1E:
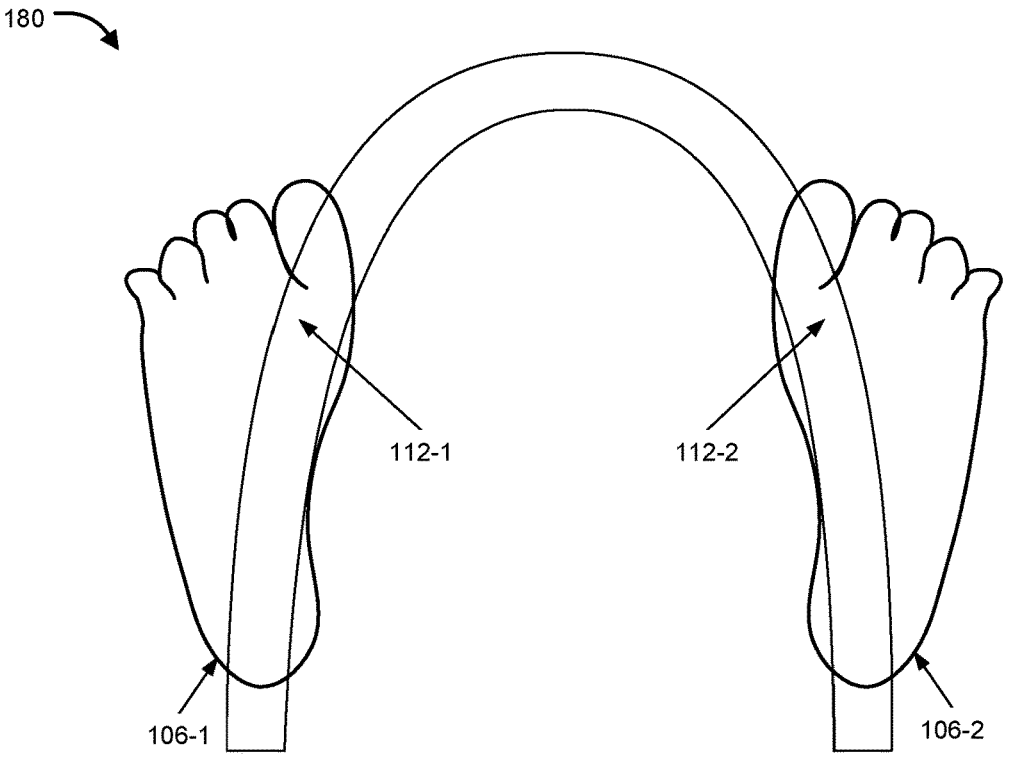

FIG. 1E illustrates the centre open foot body orientation disclosed.

In this orientation, device disclosed enables ball (112-1 and 112-2) of the big toe of each foot to be put on the frame 102, with heel's outer part (106-1 and 106-2) also resting on the frame 102, body weight being balanced on each foot accordingly.

Figure 1F:
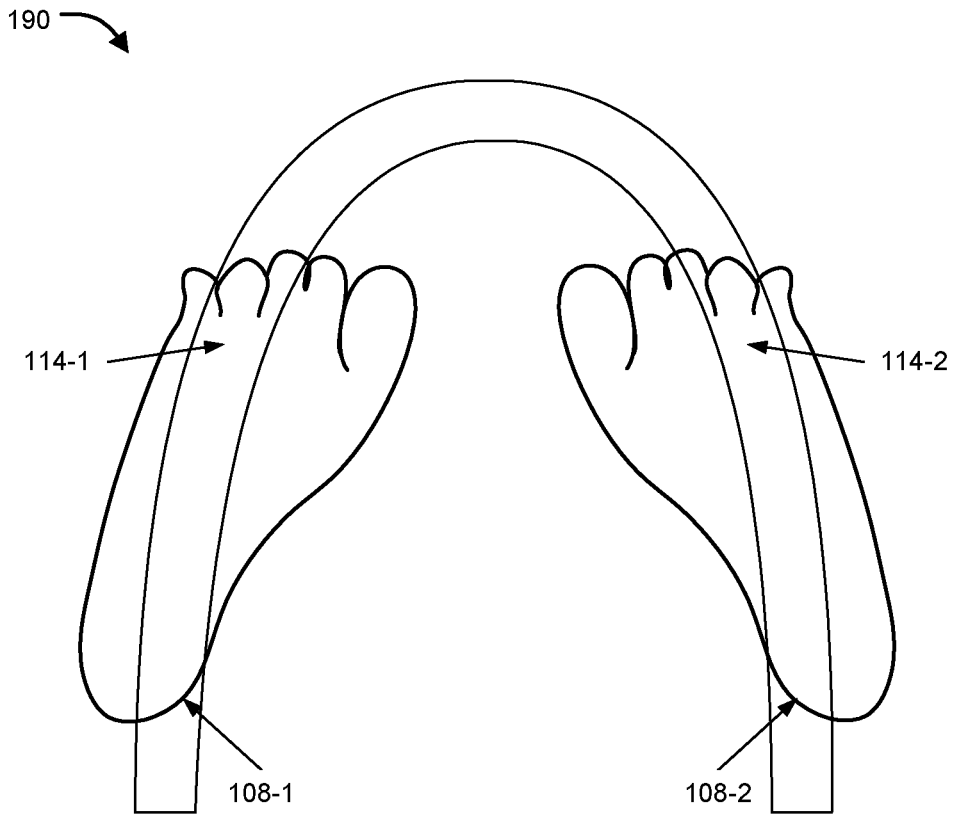

FIG. 1F illustrates the centre closed foot body orientation disclosed

In this orientation, device disclosed enables ball (114-1 and 114-2) of the outer toes of each foot to be put on the frame 102, with heel's inner part (108-1 and 108-2) also resting on the frame 102, body weight being balanced on each foot accordingly.

In an aspect the disclosed device can be used with several unique attachments in order to provide proper body and load orientation to the person so using the device, the person being, for example, a tennis sportsperson.

In an aspect such orientations can be incorporated in footwear such as insoles, shoes, slippers etc. to provide the orientations as disclosed above to the feet of persons wearing them.

Some examples of exercising using the above orientations are now disclosed.

EXAMPLE A

Universal Sports Technique that can be Used in all Orientations Along with the Punching Action Described Hereunder This technique is derived from the Punching Action" of the "JeetKune Do" martial art form. This art form provides many options for combinations of foot, leg and striking actions, during combat, depending upon the situation.

The technique requires making a fist as under.

Make a fist with the ends of the fingers tucked away, up, inside and under the knuckles, with the nails of the fingers, almost touching the starting point of the base of the respective fingers such that the fingers/fist can be kept relaxed and locked, by virtue of the fingers being held in a relaxed lock, in the fist, position.

Complete the fist by placing, thumb over the middle/second section of the fingers, with the, first joint, of the thumb (outer part of thumb) facing up or straight. At this point the fist should be held relaxed due to the fingers being locked into position, under, the inside, of the knuckles while being able to carry out "squeezing/pumping action" via fingers of the closed/locked fist.

A variation of this technique can include placing the thumb above the fist. This should not be used for actual punching.

Exemplary Method of Working Universal Sports Technique

1) Stand with both feet slightly more than shoulder width apart or generally together and centered, and toes pointed or oriented in principal outwards
2) Make fists, drop shoulder and fold/bend arms, such that the "outer point" of the bent elbows is pointing towards the ground, with fists approximately at/above the height of the collarbone while keeping the shoulders relaxed/dropped.
3) Stretch back of neck with moving forehead forward, while tucking chin in, while keeping outside of bent elbow points perpendicular to the ground. This now allows for a flexible firm connection at the neck, between the head, shoulders and back.
4) Keep the back oriented inwards.
5) Lower the centre of gravity preparing for forward motion.
6) Step forward with the leg of the side that is to execute the punching action. Keeping hips facing mainly/largely forward, turn slightly at the shoulders, while slightly turning/moving/flexing shoulder open and back, such, that the stomach muscles around the lower abdominals or groin area (approximately) are slightly stretched/engaged. The hips should be leading.
7) The beginning of this (above) motion is brought on by the moving of the fists downward, while making the elbows go in the (backwards) direction where the outer elbow point that was perpendicular earlier can now be brought to an almost parallel point (with regards to the ground surface), with the fist, of the side to be engaged, coming around/in line with the side/outer chest area or hip area.
8) Having brought the foot forward, of the side to be engaged, with the toes pointing upwards (same point is for closed orientation) and open/outwards (and turn inward/s and down for closed orientation), with the back of the heel/ankle stretched (resistance band), place foot on ground, onto the balls of the toes, with heel raised, while rest of the foot/toes of foot provide balance, onto the ground. Start the transferring of weight forward via the hip action/loading onto the balls of the toes/toes, with heel raised. This action can also be performed by putting heel to floor first and then shifting the weight onto the front part of the balls of the toes and/or toes.

9) Preparing to move the body weight/force to the engaged side and forwards, so as to start, a forward motion of the fist/arm. Bring the fist down slightly, in line with the side of the body, perform a backwards motion of the bent arm, resulting in engaging the tricep, while stretching the relaxed bicep muscle and keeping this motion anchored at same side shoulder due to relaxed and dropped shoulder. With fist at the side along with starting, to open up the bent elbow, in preparation, to begin forward motion, keep bent fingers of the fist locked and with fist intact, along with a relaxed wrist, forearm and fist. The knee of the leg is kept unlocked until now, with the leg extended forward with the front of the foot grounded as mentioned earlier.

10) With the arm/shoulder, of the engaged side, begin slight downward then forward motion, while keeping shoulder relaxed. Along with front foot pushing down into the ground with the balls of the toes/toes.

11) One should aim to punch in line with the nose or eye of the same side. One should aim to hit "through" the point of focus/object, at impact/release of motion or force. The forward part of the whiplash (whiplash action meaning "move suddenly and force fully along with downwards impulsed breathing") punching action, along with flexing of the calf muscle and/or the ankle joint allows/assists the hip, for completing total motion. This should exhaust/transfer "completely", the forces of weight transfer, forward motion and the effort of the punching action at the fist. This is brought to a focused point by the squeezing of the fist just before impact, while relaxed and firm and by bringing the load of the entire engaged side of the body, in line, with the hip "turning/moving/churning" forward and the same side shoulder/arm, ending it's forward motion.

12) The other half of the body can be a counter balance if required and/or the non playing arm can be used to squeeze the maximum transfer of momentum/force/effort into the forward punching action, along with the completion of the hip movement explained above. While the arm of the side engaged, moves forward, the other arm can be kept folded at the elbow while moving in the opposite direction, around, to the punching arm, so as to achieve maximum weight/force transfer into the impacting/whiplashing motion/affect.

13) At the point of impact or release of force, the knee and/or calf are flexed, with the heel raised, while pushing off the weight from the toes of the front foot that has been extended by pushing the toes and balls of toes, downwards into/onto the ground. Flexing the forward leg, with the help of the, joint, connecting the, foot and leg, being stretched/flexed for leverage, while pushing toes/balls of toes, into the ground allows, to flex the knee, while helping to bring the hip and fist forward in a quick burst, thus being a part of, the impacting and completing, of the whiplashing/forward punching action. An important variation to this would be to keep the knee bent while finishing with the weight transferred totally to the front foot toes. However for the reasons of beginner safety, I have recommended the first technique, for starters. In this variation the weight is transferred totally to the front foot while loading/turning/churning the hips, waist and shoulder in a more exaggerated way and a lowered and pronounced forward knee bend.

14) Use the returning whiplash momentum/motion to push foot off the ground, so as to, return to ready position.

15) While the leg is straight, momentarily, at the knee when executing the technique, by itself, this is a variable.

The foot orientation creates the energy geometry and the punching action adapted for intersectional and inline intersectional and circular intersectional impact for sports/tennis creates positive infinity (also referred to as "positive harmonic infinity" hereinafter) as described hereunder.

Positive infinity: Due to switching between closed or open orientation of the feet the polarity integrity and/or orientation/geometry is affected. Thus for sports and/or dynamic activity, one should stay mainly in one orientation throughout a shot making process. Negative infinity breaks down the muscle memory. Thus a sports technique is required which after a breakdown or loss of muscle memory has the ability to reorganize intelligence and/or the energy of the sports practitioner with increased overall efficiency which manifests as a time dimensional shift which is evident in the sports performance. Thus this increasing efficiency and existential time dimensional shift for efficiency can be achieved by the sports technique mentioned as it organizes the energy of the practitioner to its peak for the present time dimension and then breaks down whereby leaving the performer with a sense of loss of muscle memory which is actually an opportunity to achieve new muscle memory of higher efficiency. Thus the inventor does not know any other technique where this is repeatable with increasing efficiency and/or finer reorganization of intelligence. Earlier art claiming infinity does not make this distinction between positive infinity and negative infinity.

EXAMPLE B

Description and Best Method of Working of Open, Centre Open and Centre Foot Body Orientations 1) Stand with both legs straight and touching at the knees, side of the big toes and outermost points of the ankles i.e. feet together.

2) At this point the back could be curving inwards or kept straight.

3) Head Straight, looking forward.

4) With shoulders "dropped" and arms by ones side, while keeping head straight while keeping it's weight/load at the lower back and/or back of hips.

5) With big toes, touching at the sides, of the big toes to each other, open posture from the ankles/heels, while, moving the connection between the sides of the big toes, to the tips, of the big toes, while starting to unlock/bend at the knees to compensate for the change in posture. One can adjust a few times to get toes touching correctly, while, following the technique below for calibration.

6) The heels should be opened, while keeping the "ball" of the knees connected, till the knee caps meet, at the middle. The back will now curve inwards, towards the stomach, while keeping body straight and inline, mainly. This Transfers the load to the hips, while maintaining a flat footed grounding from the back of the feet all the way to the front of the feet, using balls of the toes as counter weight adjustments for balancing. Overall posture should be straight, inspite of inwards arching back.

7) At this point one can clasp both hands at the back, to assist a straight posture along with stretching of shoulders, open and down or simply keep arms at the side.
8) Hold this posture while pulling shoulders open and back, with head held straight, while keeping the neck and back connected straight and relaxed. Keeping weight at the heels/foot/hips, mainly.
9) Calibrate the point of contact at the knees by making sure that the, wider, "inner" ball of the knee joints of both legs are connected together, while the knee caps of both the knees are in touch with each other, such that (for a thin person), there is a thru gap between the connections of/between both knee joints and knee caps.
10) Further pull head back, while tucking chin in, till one can see the connection at the front of the knees, while keeping head straight and only using the eyes, looking downwards, this is a checking method to check the alignment of the back/neck/head/hips/weight distribution balance etc.
11) One may hold this posture for a while to achieve a general balance and relaxed posture for the alignment conducted earlier.
12) With hands clasped at the back one can do one type of stretching or alternatively arms on the side or moving arms just below elbow only, with shoulders pulled back, place palms facing inwards over the groin, with fingers pointing towards the centre.
13) While keeping heels and hips as the focus of the body weight and a balanced/even weight distribution between both sides, open the toes connection, while keeping knees at the same height. Putting entire weight on the heels while holding the knees bent/unlocked, the big toes should be opened, upto the point where the centre of the knee is inline/ahead of line/behind, the "gap", next to the big toe, (between the big toes and the second toe), assuming big toe is the first toe in the sequence of toes on either foot.
14) Now, one can straighten knees.
15) Weight can now be distributed from the end of the heel, to the balls of the toes, assisted and supported with the toes, depending how open the feet are held.
16) The knees can now be kept locked, while relaxing the entire body.
17) At the minimum, toes should maintain a straight line between knee with the gap of the big toe (as explained above). The foot can be opened outwards more Before one can use the technique for the above mentioned, possible uses and/or variation, the below guidelines would help in making the process, as injury free as possible, for now:

a. With the, hands at the side or from the hands at the groin position or unclasping the hands at the back, place both palms facing the body, with both thumbs inline/over the "V" of the groin, follow/move palms, along the inside of the thigh, while starting to bend the back forwards, while head kept straight, looking in front, uptill the upper body is parallel to the ground, while continuing to trace the inside of both legs with the fingers/palms moving around/down and back of both legs.
b. When one reaches parallel to the ground, the head can be held up, looking straight, while stretching neck and shoulder joint. From this same point one can flex the same point turning head down and in, starting with arching back outwards, while using the position of palms traced upto this point helping shoulders stretched, thus helping stretch the entire back. From here one can continue tracing both palms back and down the legs and calves. Before bringing head up, one should push head up, while flexing the lower back and then start upwards ascent of the upper part of the body, while continuing to trace the way back with the palms and fingers
c. Forward, sideways bending can be done using the same tracing concept.
d. Doing squats/situps either half or full, with arms at the side, in front or with arms folded at the elbow and held together till the fingertips are under the chin with head looking upwards, the folded arms technique can be used even while standing or just squatting.
e. Backwards bending can be done, with moving fingers, with straight arms, parallel to ground and in the front of the body, downwards and outwards, while starting with keeping chin tucked in till the arms reach slightly behind the ears, then moving arms and head together till the best backwards stretch can be achieved. Bring arms and head back the same way, finishing with chin tucked in, relaxing shoulders and then making head erect.

As one can see that fundamental geometry of a human is a vital aspect and affects all aspects of ones' life, this technique aims to help preserve, re-caliberate/re-align, one's original/healthy geometry to some extent, in a simple way.

This includes open, centre open and centre foot body orientations.

From this posture, even if one does nothing other than relax as much as possible and breathe, they will, derive benefits from realignment of their structure.

This Technique will also reveal various load bearing issue and their symptoms on the body.

This can help diagnose many nagging issues that sports players might be facing, due to polarized action and/or musculoskeletal issues and/or certain body conditionings.

Most importantly, this posture or combinations of postures can be used for carrying out various stretching exercises that will stretch muscles correctly, thus helping give an experience of true stretching and it's benefits.

The number of exercise combinations that can be achieved from these postures are endless.

Following this technique in the gym will create the correct load bearing in the body. This will create a standard way to use weights with regards to body building and prevent numerous injuries as now the polarization of the athlete will be kept in check. This can extend the interest in going to the gym as one will have a clear starting point from which to gauge their performance and injury prevention will mean more people going to the gym, more often because now they can feel their muscles function much better during performance. Hence they can build a stable positive relationship with working out or stretching.

If squats are done using this technique, they are far more potent since now the weight is ACTUALLY properly distributed between both legs and thighs and the rest of the body.

This technique helps the back relax so it can be used in the medical field, or for simply standing during security duty or children's school assembly.

This technique can also be cultivated to achieve various weight lifting techniques.

This technique can be use for designing equipment for various sports for a calibrated set of equipment.

This technique can be used in offices for employees to carry out stretching or by players as warm up and/or cool down.

Our respectable seniors who hold the tradition of morning walks and exercise will be very happy to have such a simple and workable tool that they can use to reduce their aches and pains.

Figure 2:
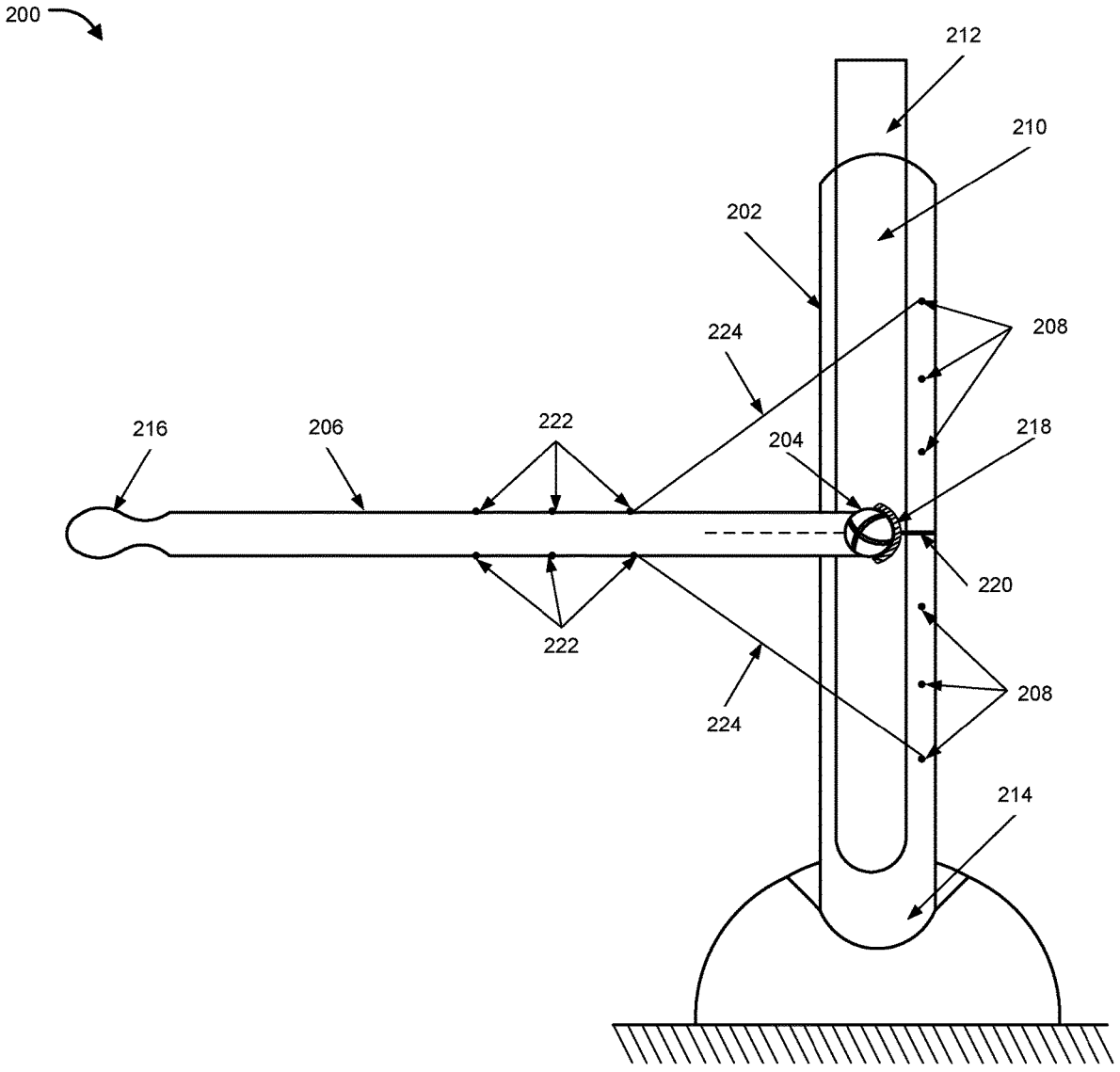
FIG. 2 illustrates a force application intersectional impact point and resulting body loading machine, in accordance with an exemplary embodiment of the present disclosure.

FIG. 2 illustrates a force application intersectional impact point and resulting body loading machine, in accordance with an exemplary embodiment of the present disclosure.

In another aspect, invention disclosed can include a force application intersectional impact point and resulting body loading machine (hereinafter called force machine 200) that is operatively connected with the foot orientation device disclosed above vide FIG. 1A to FIG. 1E in order to enable a person to operate the former in a manner as described hereunder, while maintaining a foot orientation enabled by device disclosed above.

In an aspect, the twisting machine comprises a base that allows different energy orientations to be achieved, wherein a portion of the base is cut out to facilitate said energy orientations.

The machine disclosed enables an operator to put force on a ball in a punching pathway loading action (as per details earlier filed by inventor) and thereby loading the body parts such as legs, hips, back etc. whereas existing training devices and machines allow only for a swinging action to the hand.

In an aspect the force machine 200 can include a pole 202 that can have a channel 210 in which a ball 204 can be held in its socket 218 at different heights (in accordance with height of the operator or body part to be loaded) using a suitable clamping device shown as 220. The ball 204 can in turn be attached to a lever 206 that can be used to rotate the ball 204 in its socket 218 in any direction. Pole 202 and lever 206 can be configured with resistive bands using a plurality of holes 208, 222, 224 as shown to impart variable resistance to such a motion of the lever 206.

Both the ball 204 and the lever 206 can be removable and/or replaceable if required. In an aspect, lever 206 can be of adjustable length by any means.

In this fashion, the lever 206 and ball 204 when moved in conjunction with the device disclosed as in FIG. 1 can allow for proper centre loading of the operators' body with its attendant benefits as explained in the advantages and benefits of the device.

In another aspect, the force machine can have adaptor 212 that can be used to connect the force machine with other exemplary devices, for example a punching bag, long resistance band, exercise ropes etc.

In yet another aspect the pole 202 can be made pivotable around pivot 214 so that it can be pushed or pulled at any angle using lever 206. In another aspect, pivot 214 can also be configured with adjustable resistive devices (such as resistance bands) to provide adjustable resistance to its movement in any direction. In another aspect pivot 214 can also be affixed rigidly to the ground if so required.

In yet another aspect the lever 206 can be made in a fashion that it's length can be varied to that of a tennis racquet, cricket bat, golf club for example.

In another embodiment, the lever 206 can be attached at its gripping end (that is the end away from the ball 204) to a grip 216 that can be configured in its shape, contour, height, thickness etc. in line with the grip that the operator intends to practice for example a golf club, badminton racket, tennis racquet etc.

In an aspect the lever 206 can be so configured that it can handle further attachments if required.

In an exemplary embodiment lever 206 can be attached at its gripping end to resistance bands that can be held over the shoulder of the operator in such a fashion as to enable him to learn correct impulse breathing for intersectional impact techniques and/or its pathways.

In another embodiment, the grip 216 can be curved in a fashion appropriate for more precision based use or loading of the grip.

In a further embodiment various grips as used in other sport implements such as golf clubs, badminton racquets can be used.

In another aspect, the gripping end of lever 206 can be configured to be attached to the grip 216 at different angles to enable the grip 216 to put force on lever 206 at different angles.

In another embodiment the lever 206 can be made of a hollow tube on the surface of which the ball 204 can be loosely passed, one end of the lever 206 configured with a stopper to stop the ball from falling out of the lever 206. Such a device can be used to practice proper swinging techniques say, for example, lawn tennis strokes.

In another embodiment the lever 206 can be made of a hollow tube holding at its other end the ball 204. The hollow tube lever 206 and the ball 204 can be removed from device 200 and ball 204 further configured with the hollow tube lever to provide further exercising options as elaborated in FIG. 5.

Figure 3:
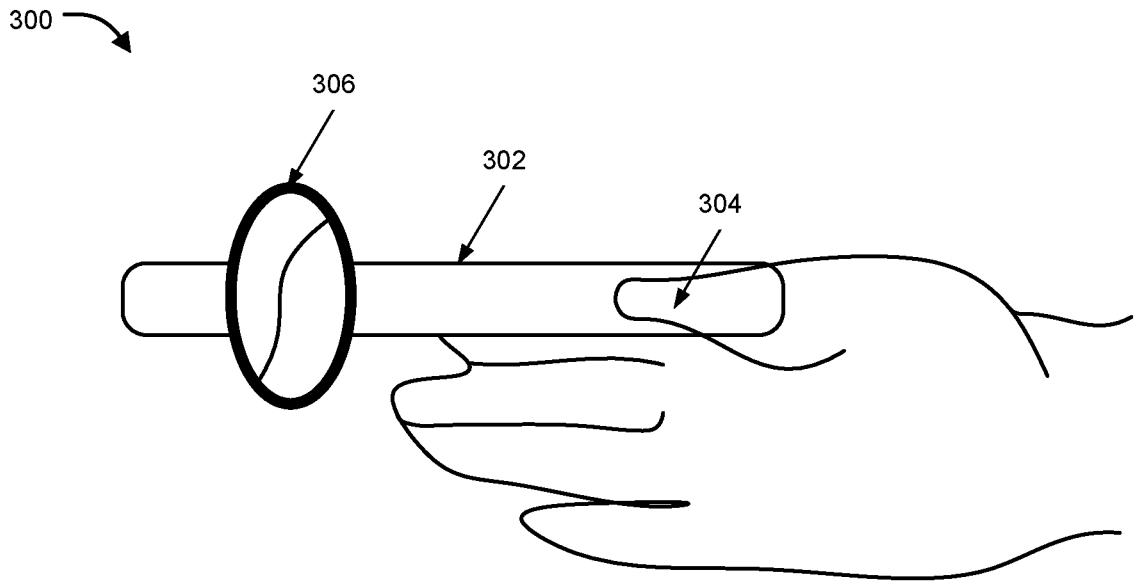
FIG. 3 illustrates a single orientation thumb through exerciser, in accordance with an exemplary embodiment of the present disclosure.

FIG. 3 illustrates a single orientation thumb through exerciser, in accordance with an exemplary embodiment of the present disclosure.

In an exemplary embodiment the disclosed device can be used along with an a single orientation thumb through exerciser 300 as illustrated in FIG. 3, the single orientation thumb through exerciser 300 also forming part of this disclosure.

As illustrated the single orientation thumb through exerciser 300 disclosed can include a tube 302 that can be configured to be affixed on a sportspersons' thumb shown as 304 and can carry a ball (306) that can be, say, a tennis ball on it. The tube 302 can be pierced through the ball 306 as shown and can hold the ball 306 at any place along its length.

The tube 302 with the ball 306 attached can be put over thumb 304 of the sportsman hand, while he is standing in any of the foot orientations described above except the closed foot body orientation for maximum benefit, the purpose of the sportsman being to move his thumb in vertical or horizontal plane so as to learn loading of the thumb and its effects all over the body which go definitely till the hip or lower back and/or possibly all the way to the feet.

Figure 4:
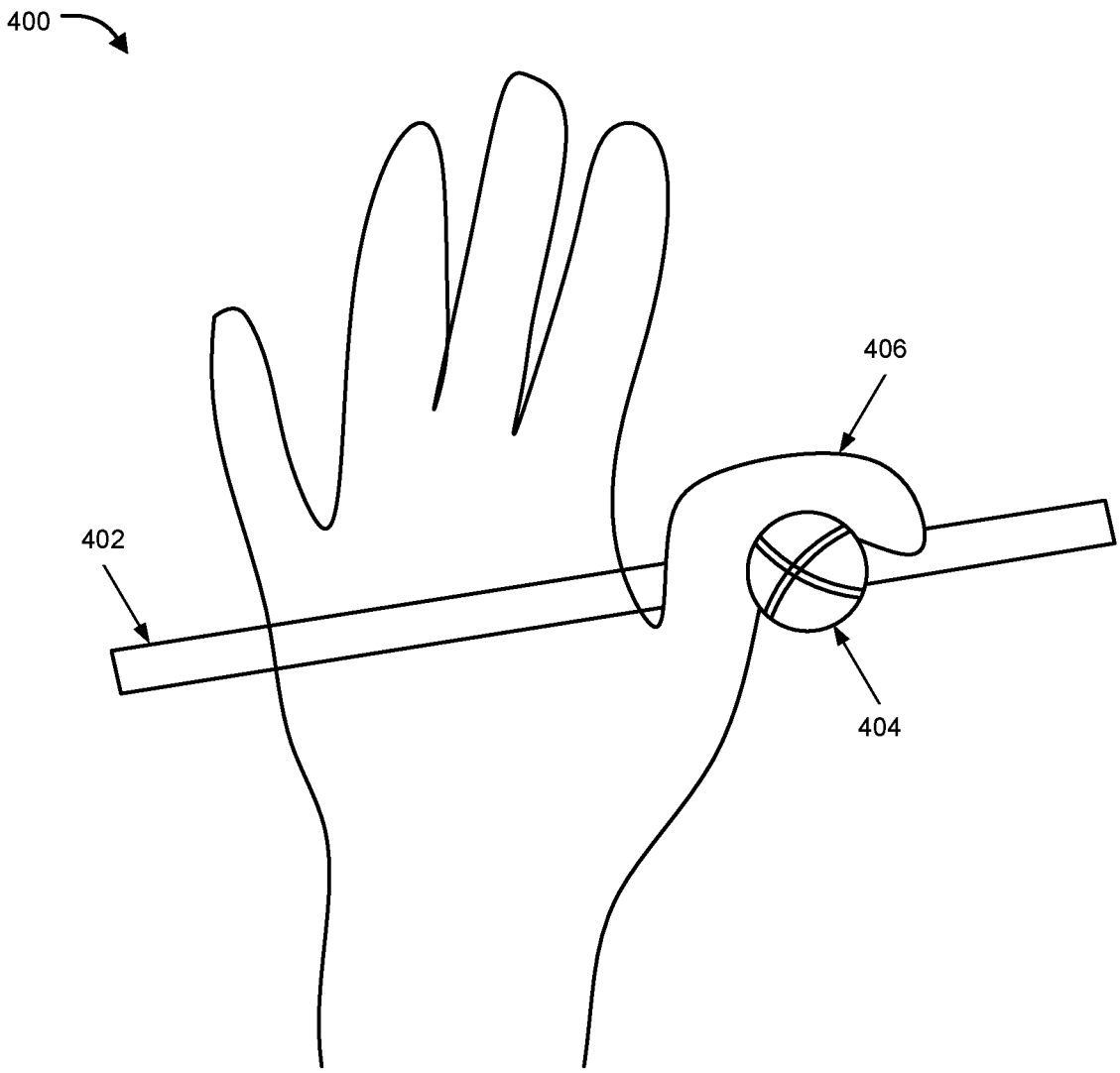
FIG. 4 illustrates a multi orientation thumb through/loading/flexing/squeezing exerciser, in accordance with an exemplary embodiment of the present disclosure.

FIG. 4 illustrates a multi orientation thumb through exerciser, in accordance with an exemplary embodiment of the present disclosure.

In an exemplary embodiment the disclosed device can be used along with a multi orientation thumb through exerciser 400 as illustrated in FIG. 4, the multi orientation thumb through exerciser 400 also forming part of this disclosure.

In an aspect, the a multi orientation thumb through exerciser 400 can include a thin rod 402 that can be pierced through a ball 404 that can be a tennis ball. The rod 402 can be held in the crook of the thumb 406 in such a fashion (as shown) that the ball 404 is right next/inside to the thumb 406, as illustrated in FIG. 4. This embodiment can be practiced in closed foot body orientation disclosed above (FIG. 1C), the purpose of the sportsman being to try to wrap his thumb around the tennis ball. In an aspect, the exerciser rod can also be squeezed by the thumbs.

This teaches correct wrist motion for application while largely keeping hand and fingers straight while curving thumb around the ball, the thumb curving showing the pathway for correct wrist pullback action pathway/way and/or wrist loading through circular orientation play or when dominant foot is behind the hip.

Figure 5:
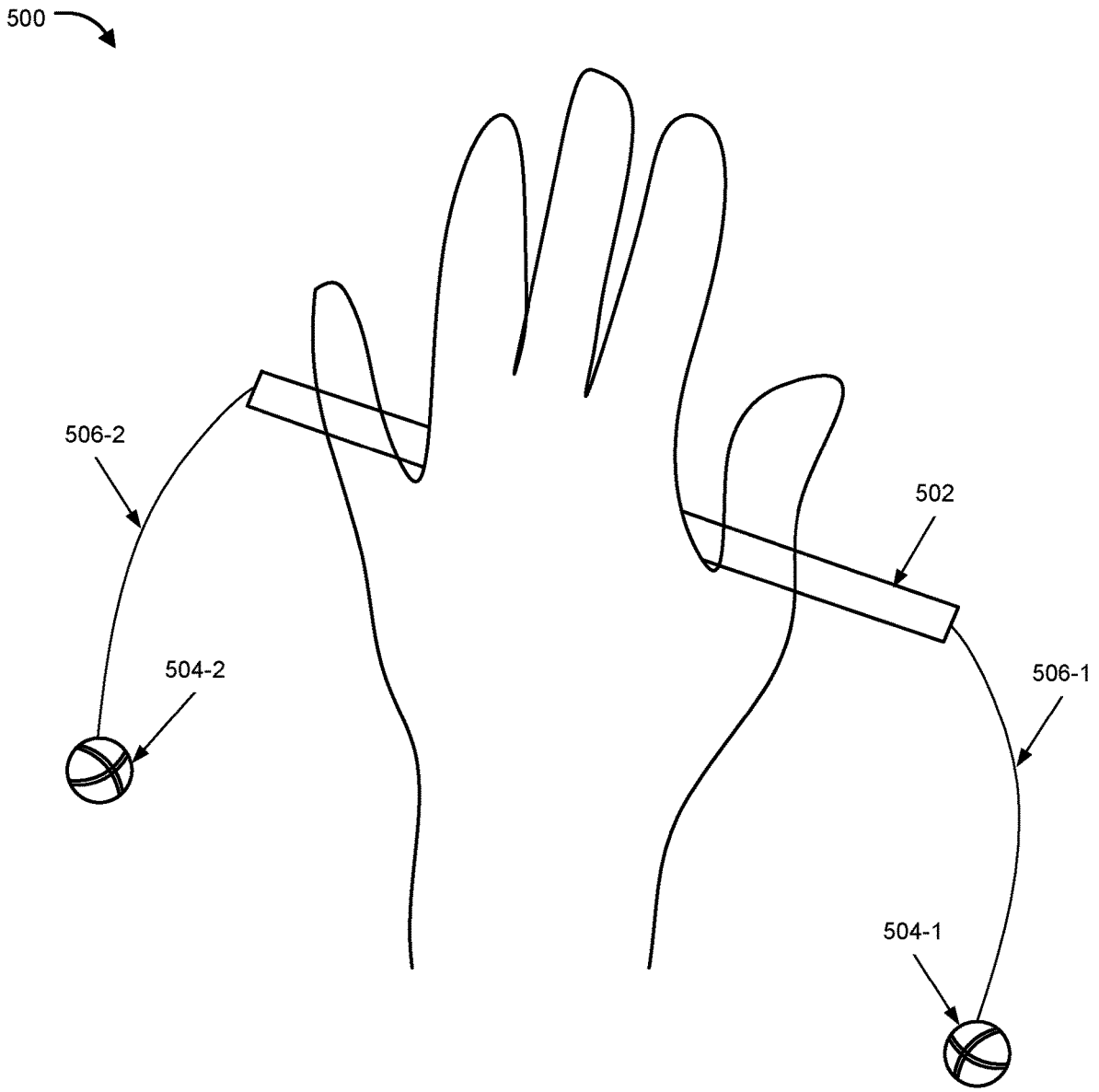
FIG. 5 illustrates a dynamic hand alignment exerciser, in accordance with an exemplary embodiment of the present disclosure.

FIG. 5 illustrates a dynamic hand alignment exerciser, in accordance with an exemplary embodiment of the present disclosure.

In an exemplary embodiment the disclosed device can be used along with a dynamic hand alignment exerciser 500 as illustrated in FIG. 5, the dynamic hand alignment exerciser 500 also forming part of this disclosure.

The dynamic hand alignment exerciser 500 can include a rod 502 that can have small balls 504-1 and 504-2 attached to its ends using pieces of strings 506-1 and 506-2 as shown. In another aspect the rod 502, balls 504-1 and 504-2 and strings 506-1 and 506-2 can be so sized and configured with each other that the rod 502 can be passed through the crook of thumb and index finger, inner/outer palm and the crook of ring finger and pinky in the manner as illustrated to enable the rod 502 to be turned and thereby swing the balls 504-1 and 504-2 in such a fashion that one ball hits the palm while the other hits the back of the palm in the approximate centre of the respective areas.

This exercise can enable a sportsman to learn the correct wrist motion for playing sports such as tennis, badminton, cricket etc. Indeed, it can also strengthen the wrist for playing musical instruments such as pakhawaj. This can also be applied to music and music instruments for the thumb loading/orientation devices.

In an aspect, energy orientations (also simply referred to as "orientations" hereinafter) can create various conditionings that further create form and functional changes to various actions of a user so as to compliment the action, that could be phase sensitive, and where orientations based upon energy and/or phase coherence can be used for creating form and function that are aimed at being coherent for intersectional type interactions in keeping with phase/polarity coherence.

In an aspect, orientations and/or their combinations/progressions based simulations can be used to design and develop various geometries, phase/polarity sensitive product development, energy monitoring and form and function monitoring.

Mould for Foot

An attachment in the form of a mould for the foot literally representing earlier filed footwork technique is disclosed that helps learn how to apply the open foot body and closed foot body orientations disclosed above. The mould comprises a curved shape one end of which holds heel of the foot, other end being raised and holding and stretching the toes and the foot. The heel side end can further pivot for applying these orientations.

Foot Through Exerciser

Invention also discloses foot through exerciser that can include a big ball say the size of a football that can be attached via a flexible mechanism to a tube/rod, the tube/stand/rod being moved to provide right pathways and foot orientations to a person using the device for proper learning, while the ball remains immoveable.

In another aspect, the ball as described above can be held in a socket so that the ball can rotate in its place, other aspects being same as above.

In yet another aspect, the tube can pass through the ball, and the ball can also be made moveable.

Tension Adjustable Resistive Band

In an aspect, invention disclosed includes one or a plurality of tension adjustable resistive bands wherein the band can be so adjusted as to provide free movement during initial motion of a body part and tension during the latter part of that motion, or vice versa. In an exemplary embodiment, for example, such a band can be affixed to between the fist and the shoulder of an arm so as to provide, during a punching motion, free movement of the arm initially and latter, at close to the end of the punching motion, resistive force against the direction of punching.

Brace

In an aspect, invention disclosed can include one or a plurality of braces that can be put on various body parts and can be configured to allow movement of such body parts in only a controlled fashion such as of direction and pathways. Such braces then can be operatively connected with various data collection devices suitable so as to enable data collection of such movements of different users to be done in a standardized fashion that allows for uniform comparisons for evaluation and training purposes.

The priority of this is according to the earlier invention filed by the inventor.

In another aspect, the brace can additionally be configured to hold materials suitable to provide additional loading to the body parts or healing or flow properties as required. In an exemplary embodiment, the brace can hold water that can enable person wearing it to learn how force can flow from that body part. The temperature of the water can be varied to, for example, provide healing to strained part.

In another aspect braces can be in geometrical shapes of X, I, - - - , circular, semi-circular and any combination of these.

Method of Making a Reference Ball

Invention disclosed also discloses a method of making balanced shape. In an exemplary embodiment, for making a balanced ball the method includes:

taking a sample ball and marking two opposite points (that can be called a first mark and a second mark) on centre of the two hemispheres of the ball piercing a needle through first mark maintaining a zero degree deviation of the needle from the horizontal plane and determining whether the needle passes through the second mark and so determine a degree of deviation of the needle from the second mark.

Based on degree of deviation expanding or compressing the two halves of the ball until a zero degree of deviation is achieved.

suggesting amount of skewing based on the skewing required for the ball to achieve a ball of desired standard or behavior.

The method can be applied on any other shape and size suitable,

In yet another aspect all the materials and physical parameters of shapes so made have to be compensated by at least twenty five percent so as to enhance durability of the shape and for better learning experience. In exemplary embodiments, such compensation can be in for example, volume, color, density of construction material, core of the shape, thickness of covering materials, porousness etc.

Ball with String

The invention also discloses a ball as made by the above method that can in turn be configured with a string that can be in turn attached to any of the braces disclosed above to provide various exercise and training opportunities, primarily ball kicking exercise to learn correct footwork for different sports.

Thumb Spacer for Weight Training

A thumb spacer is disclosed that comprises a ball made with the method disclosed. The ball can have a through hole in it enabling the spacer to be held over the thumb in such a fashion that during weight lifting, the thumb also shares the load optimally along with the other fingers.

Centre Loading Bar

The present disclosure further provides a center loading bar comprising load to be fixed in the center of the bar for unique weight training loadings or for center loading of a user so as to allow center integrated loading of the body of the user. A centre loading bar for weight training with possibly special weights, the centre hole of the weights being big enough to be slipped all the way through to the middle of the bar. The bar can have holes in it so as to lock the weight in place or can have clamps. The bar can also have a thumb spacer principle where the thumbs are loaded correctly. Adjustments to the structure of the bar could be made so as to allow for regular weights to be incorporated. The main goal here is for example, if the centre weight is 1 Kg then adding similar 1 kg weights on either side of the centre weight, taking the weight progression from 1 kg to 3 kgs whereas earlier it would move from 2 kgs to 4 kgs. The principle of centre loading elaborated here is being claimed.

Twisting Machine

Invention also discloses a twisting machine the base of that can enable the various orientations disclosed. In an aspect, the base of the twister can be cut one quarter to facilitate such orientations and the twisting motion can be granted a variable resistance.

Figure 6:
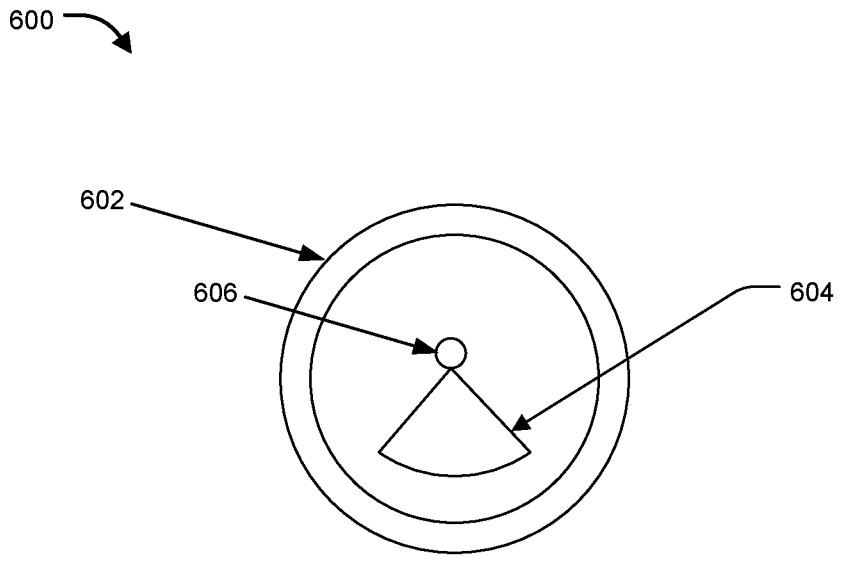
FIG. 6 illustrates a twisting machine, in accordance with an exemplary embodiment of the present disclosure.

Referring to FIG. 6, a twisting machine 600 is shown having a base 602 and a cut-out 604 in the form of a quarter cut-out that facilitates various energy orientations of body of a user. A variable resistance 406 can be provided to the twisting machine 600 so as to allow a resistance based loading of the energy orientations of the body of the user.

In an aspect, the proposed twisting machine 600 can be used for sports, training and physiotherapy to enhance/improve design as well as functional characteristics of the user.

In an aspect, loading and/or orientation data derived from the twisting machine 600 can be extracted and simulated by data collection device 700 (as shown clearly in FIG. 7) and based on output of the data collection device 700, the design and functional characteristics of the user can be improved based on one or more reference points derived by the energy orientation of body of the user and various loading and impact positions such as inline loading and intersectional loading.

Loading Machine

A loading machine is disclosed that can enable a user to load his/her body for learning and improving body loadings and body parts interaction for intersectional impact principle, wherein the loading machine comprises a pivotable pole with fixed and or variable resistance having a channel in which a socket holding a ball is fixed at one or more specific positions, and wherein the ball is movable in any direction using a lever that is configured with a resistive mechanism to impart resistance to movement of the ball and or the lever.

Geometric Shape

A method for developing an article having a defined geometry is disclosed, wherein the method includes steps of analyzing one or more reference points associated with the geometry of the article, and implementing energy and phase based predictive reference function on the one or more reference points to support orientation based conditioning of the article.

In an aspect, loading data derived from the device relating to the one or more energy orientations is used for design and development of footwear.

Similarly, a geometric shape can be used where a person stands in the center of the geometric shape and lifts the said shape that can be loaded in various ways and with various weights to achieve centre integrated loading of the body.

In an aspect, all the disclosures elaborated above can be accompanied with proper instruction manuals, leaflets, audio/video clips as appropriate so as to explain their proper functioning to operators.

In an aspect, a geometric/reference shape is a reference parameter used to derive or develop a shape. The reference shape can be sensitive to the data derived and can be a representation of intersectional type interaction or impact geometry.

System to Create Form and Function

A parameter based system to create form and functions is disclosed that is based upon any or a combination of orientations of energy and energy geometry, wherein the orientations are complimented with intersectional type interactions to create conditionings or reorganizations to at least one aspect of the form and functions of at least one entity, and wherein the conditionings are achieved to create progressions coherent to the parameters to create or reorganize at least one aspect of the form and functions that is increasingly coherent for phase sensitive responses.

In an aspect, loading data derived from functioning of the parameters are used to design and develop products and for training of the at least one entity.

Data Collection Device

Figure 7:
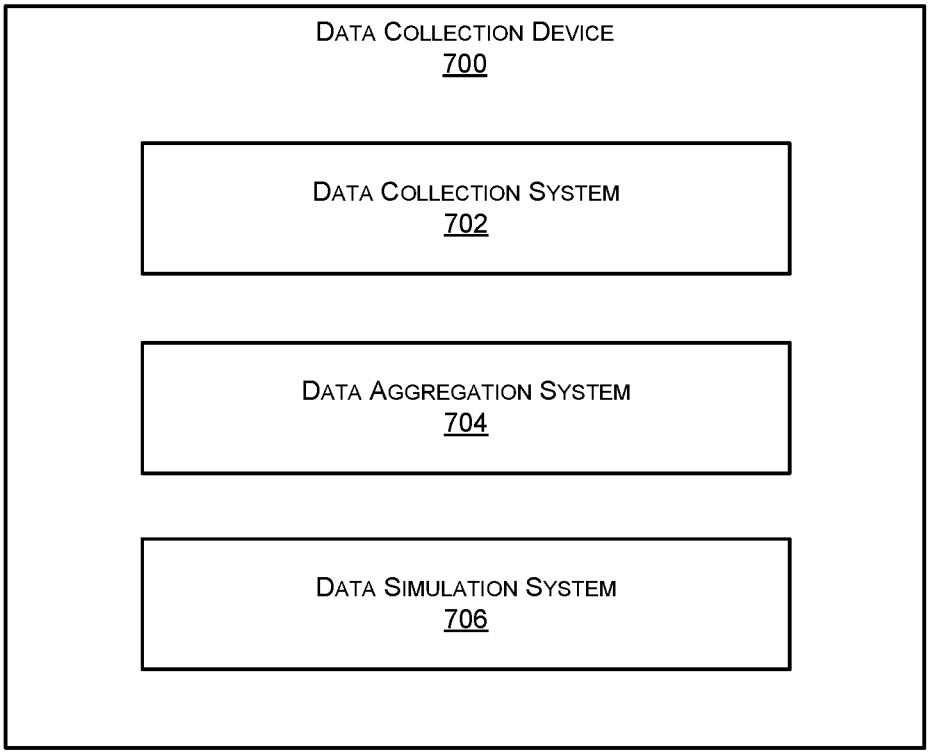
FIG. 7 illustrates a data collection device, in accordance with an exemplary embodiment of the present disclosure.

Referring now to FIG. 7, a data collection device 700 is disclosed that includes a data collection system 702 configured to detect design parameters and form and functional parameters of an entity based on movement of said entity, a data aggregation system 704 configured to enable aggregation of the design parameters and form and functional parameters of the entity, and further configured to generate a multi-calibrated data based on said aggregation, wherein the multi-calibrated data includes information of a plurality of reference points, and a data simulation system 706 configured to simulate the multi-calibrated data of the entity with respect to at least one of the plurality of reference points so as to enable enhancement of the design parameters and form and functional parameters of the entity.

In an aspect, the entity can be selected form the group consisting of a human being, a product, a sports equipment, a fitness equipment and a physiotherapy device/product.

In an aspect, design parameters and form and functional parameters of the entity pertains to functional as well as design characteristics of the entity such as, including but not limited to, height, weight, shape, size, energy orientation, intersectional interaction and inline interaction characteristics. In an aspect, the enhanced design parameters and form and functional parameters of the entity is used for design and development of human actions, sports equipments, training equipments, physiotherapy products and engineered products.

In an aspect, the data aggregation system 702 can enable transmission of the multi-calibrated data between various data collection devices and can further enable transmission of the multi-calibrated data from a data collection device to a computing device for further computation/analysis.

In an aspect, multi-calibrated data derived from the data collection device 700 can be used for ergonomics and/or for applications where human interaction is available, as the data is inclusive of human and matter functioning and their efficiency or interactions efficiency. Thus, the data can be used for design and development of products made for human energetic functioning and/or response and/or ergonomics. In an aspect, the multi-calibrated data can be used for calibration of the design parameters and form and functional parameters of the entity in various domains such as engineering, sports, fitness, and physiotherapy. Additionally, the data can be phase sensitive and can be used as a standalone source to implement enhancement of form and function of the entity.

In an aspect, the data collection device 700 can be coupled with any or a combination of the reference shaping tool, the reference geometry, and to other tools as disclosed herein. In addition, the orientation based simulation of the data can be applied in various ways by using various mathematical and statistical models.

In an aspect, the data collection device 700 can be attached to a body brace configured with a body part of a user. In an aspect, the body brace is of any or a combination of X, I, - - - , circular, semi-circular, oval, opposite semi-circular or hollow shape.

In an aspect, functional data derived from the data collection device 700 can be phase dependent energy functions and/or energy functions based on manipulation of energy for phase/polarity coherence.

In an aspect, the plurality of reference points associate with them information about positive harmonic infinity condition of the entity that allows the entity to pertain axiomatic design that can sustain their functional requirements and further, allow for structural as well as functional improvement of the entity.

In an aspect, the data collection device 700 can be used for design and development of a product at an initial or an intermediate stage of its development or in multiple repeated stages. Such application of the device 700 can be possible where progression of form and functions of the product are phase coherent and/or sensitive to the parameters of form and function disclosed herein, where products filed can be based upon the data disclosed and or be made generally. Further such data, parameters and reference shape can be used in the initial stage so as to make products coherent for phase/polarity based form and function in any order, depending upon the products and its function so as to create progressions in design that are phase coherent.

Due to simplicity of the parameters involved in enhancement of form and function of the entity, application of the parameters can be achieved on a pre-existing computer system, where parameters are applied, data is collected, and reference shaping tool is used or simulated to create form and function. This can be used as an initial set of parameters and can be used in various ways or combinations, such as data only, and/or for intersectional impact analysis and simulation and/or for orientations based simulations and applications.

In an aspect, data collection devices 700 can include mobile phones, applications, televisions, grabs, cameras, or a player practicing the technique and/or applying the technique that can process a mathematical model, a scientific model, a sonic or sound parameter based data, wave and particle type data, vectors, centrifugal as well as centripetal interaction, orientations, impact types such as intersectional and inline intersectional based upon the technique as disclosed herein for various orientations.

It would be appreciated that the data collection device 700 can be attached to a body brace attached to a body part of a user. In addition, the data collection device 700 can also be configured with various tools and products disclosed herein and other products such as sports equipments, training equipments, physiotherapy products and engineered products. Thus, application of the data collection device 700 as explained does not limit the scope of the present disclosure whatsoever.

In an aspect, application of the data that can be standardized for accessing various operational improvement in domains such as sports, arts, engineering and other domains, for training as well as cross-training, and for making products based upon the parameters either applied stand alone or applied via using the disclosed products, such as the foot orientation device for footwear, making various types of multiple foot orientations devices and making improvements to the products disclosed based upon data derived. It would be appreciated that embodiments explained herein are only exemplary and does not limit the scope of the present disclosure whatsoever.

Multi Sports Clarification where the technique is associated correctly for the common points of the body to function commonly for various sports and thus creating equipments for a fundamental/universal type of technique, only then should someone be allowed to claim a multi or various or universal sports brace.

While the foregoing describes various embodiments of the disclosure, other and further embodiments of the disclosure may be devised without departing from the basic scope thereof. The scope of the disclosure is determined by the claims that follow. The disclosure is not limited to the described embodiments, versions or examples, which are included to enable a person having ordinary skill in the art to make and use the disclosure when combined with information and knowledge available to the person having ordinary skill in the art.

Many other scientific aspects of the technique disclosed such as challenge to law of equal and opposite reaction, possibility of ready position for tennis becoming narrower due to conditioning achieved from the technique are not being elaborated herein but can be considered part of the disclosure.

Please try the variety of older techniques on such a product that claims to be universal and one will soon realize that, unless a universal technique is not guiding the product, such claims are basically wishful thinking, thus such work should only be granted a patent after a universal technique is associated with such claims. The inventor of such a technique, is the person filing this patent, where all filings are mainly focused towards, this one universal sports technique that matches Indian classical science to sports along with basics of martial arts practice in a sports oriented way. Thus though the claims have obviously not been narrowed down specifically for this, the inventor mainly wishes to function to establish this technique correctly, since he is the one who has come up with it after a lifetime of research. Thank you.

The inventor cannot give long theories here, however the inventor will mail the print outs and photo copies for the hand written notes to himself as regards such works, so as to present it as associated educational content programs developed for the particular techniques associated with the filing/s. There are also at least two walking techniques that have also been developed based upon orientation and stride lengths.

This includes the merging of sports technique/music/mathematics/experiential understandings of the same and or unique analogies to compliment the life learning that can be derived from the use of such techniques as associated with the equipment filed.

Advantages of the Invention

The technique and devices disclose correct ways to build muscles in an intuitive and interesting way.

The calibrated stretching and warming up exercises can easily be made available to all minimizing polarities and misalignments that have occurred due to bad habitual posture and/or activities.

The techniques and devices disclosed can enable workers to perform basic stretching and warm up exercises easily in order to keep their body properly aligned.

For casual players the technique and devices disclosed can be used for a quick and effective warm-up, ensuring proper body preparedness before play begins.

Space requirements are minimal and so can be used in constricted spaces.

Musicians, stage performers and others can use techniques and devices disclosed as tool of relaxation and realignment before performance.

Medical professionals can find the techniques and devices useful for their patients.

What is claimed is:

1. A method for developing at least one tool and/or a process for physical development and/or training, the method comprising steps of:

collecting, by a data collection device, standardized data generated by movement of a body in a controlled and standardized fashion through execution of one or more pre-defined techniques; and developing the at least one tool and/or a process based on processing of said collected standardized data, wherein said pre-defined techniques enable generation of data pertaining to any or a combination of body's orientation data, loading data for hard and soft parts of the body, timing data, scientific data pertaining to polarity coherence, conditioning based data, body data, and medical data, and wherein said one or more pre-defined techniques are selected from any or a combination of punching technique, foot orientation technique, and intersectional impact based technique, wherein said process creates a balanced shape, said process comprising the steps of:

marking a first point and a second point on center of two hemispheres of a ball;

piercing a needle through the first point maintaining zero degree deviation from horizontal plane;

determining whether the needle passes through the second point to determine degree of deviation of the needle from the second point;

based on the degree of deviation, expanding or compressing two halves of the ball until a zero degree of deviation is achieved;

creating the balanced shape based on the zero degree of deviation; and creating at least one final ball based on the balanced shape, wherein for the at least one final ball to function, a minimum quarter space rule compensation is required and presents itself as a variation choice, wherein the balanced shape is configured for proportioning or shaping of other shapes and/or their behaviour, and wherein the balanced shape is configured for training and is the fundamental geometry and/or ball size reference for all possible tools.

2. The method as claimed in claim 1, wherein said at least one tool is a foot orientation device having a semi-oval shaped frame, wherein the frame is configured to accommodate both feet of a user in one or more orientations selected from open foot body orientation, closed foot body orientation, center foot body orientation, center open foot body orientation, and center closed foot body orientation, wherein any of these orientations enable the user to practice and achieve alignment of at least one body part and learn loading of the foot/feet in each orientation to match center of gravity for orientations and understand positioning and relationship/loadings of hip and back, and wherein when a dominant foot is in open orientation, the user uses straight line pathway for an intersectional impact creation, and wherein when the dominant foot is in closed orientation, the user uses circular line pathway for the intersectional impact creation.

3. The method as claimed in claim 2, wherein when the dominant foot is in center orientation, the user has an option to choose the circular line pathway or the straight line pathway or a combination thereof for an in-line intersectional impact.

4. The method as claimed in claim 2, wherein the foot orientation device is operatively coupled with a loading machine, and wherein the loading machine enables a user to load his/her body for learning and improving body loadings and body parts interaction for intersectional impact principle, further wherein the loading machine comprises a pole having a channel in which a socket holding a ball is fixed at a position, and wherein the ball is movable in any direction using a lever and/or is configured with a resistive mechanism to impart resistance to movement of the ball and/or the lever.

5. The method as claimed in claim 4, wherein height of the ball on the pole is adjustable to create variety of loadings of body of the user representing various heights impact points.

6. The method as claimed in claim 4, wherein a plurality of holes are configured on the pole to provide variable resistance through use of various heights or angles.

7. The method as claimed in claim 4, wherein the pole is configured with an adapter at its top, wherein the adapter is used for connecting any or a combination of a bladder, a punching bag, and a resistance band.

8. The method as claimed in claim 4, wherein the lever and the ball are detachable from the pole and used for inline intersectional impact, and wherein the lever is hollow and operatively coupled with a detachable handle such that the handle when detached from the lever is usable as a thumb loading exerciser.

9. The method as claimed in claim 4, wherein the foot orientation device is operatively coupled with an orientation thumb loading exerciser to achieve open foot body orientation along with thumb loadings to the user.

10. The method as claimed in claim 9, wherein the orientation thumb loading exerciser is a single-orientation loading exerciser or a multi-orientation loading exerciser.

11. The method as claimed in claim 9, wherein the thumb loading exerciser is coupled with a ball.

12. The method as claimed in claim 9, wherein the thumb loading exerciser is operatively coupled with a body brace, wherein the body brace is configured to function in a way that enables the user to apply a punching action for a straight line orientation so that a dominant side foot is in open position/orientation, and apply the punching action in a circular orientation manner for circular orientation of energy when the dominant side foot is in closed position.

13. The method as claimed in claim 12, wherein the body brace is of any or a combination of X, I, - - - , circular, semi-circular, oval, or opposite semi-circular shape.

14. The method as claimed in claim 1, wherein the at least one tool is a tension adjustable resistive band that is configured on a user such that when then foot of the user is relaxed, the band pulls the foot upwards to common point for all orientations and as part of a multi sports technique, and wherein when the foot is upward, a desired orientation is applied.

15. The method as claimed in claim 14, wherein the band is operatively coupled with a foot through exerciser for a large ball, wherein the foot through exerciser comprises a pipe that is coupled with the large ball such that the pipe is movable from side-to-side without moving the large ball to enable understanding of how the large ball should be approached through foot for impact creation.

16. The method as claimed in claim 1, wherein the balanced shape is configured to be used on a string attached to a body brace.

17. The method as claimed in claim 1, wherein the balanced shape is reduced in size so as to allow the ball to be used as a thumb spacer, wherein the thumb spacer has a hole that allows for the thumb spacer to be installed upon and around a thumb of the user.

18. The method as claimed in claim 1, wherein the at least one tool comprises a center loading bar having a load to be fixed in the center of the bar for weight training or for center loading of a user so as to allow center integrated loading of the body of a user.

19. The method as claimed in claim 1, wherein the data collection device is configured to print at least a portion of said collected data on a tangible medium.

* * * * *